US005152120A

United States Patent [19]

Huang

[11] Patent Number: 5,152,120

[45] Date of Patent: Oct. 6, 1992

[54] LATEX LID MOUNTING APPARATUS

[76] Inventor: Chung-Wei Huang, No. 8-3, Lin 8, Hsia-Nei-Li, Nei-Ting Li, Chungli City, Taiwan

[21] Appl. No.: 747,979

[22] Filed: Aug. 21, 1991

[51] Int. Cl.[5] ..... B65B 7/28

[52] U.S. Cl. ..... 53/309; 53/349; 53/353; 221/210

[58] Field of Search ..... 221/210, 220; 53/309, 53/305, 349, 353

[56] References Cited

U.S. PATENT DOCUMENTS

| | | | |
|---|---|---|---|
| 982,231 | 1/1911 | Barry | 53/309 |
| 2,325,164 | 7/1943 | Goodwin | 221/210 |
| 3,905,178 | 9/1975 | West | 53/309 X |
| 4,222,214 | 9/1980 | Schultz et al. | 53/309 |
| 4,967,930 | 11/1990 | Koltze | 221/210 X |

*Primary Examiner*—Robert L. Spruill
*Assistant Examiner*—Daniel B. Moon
*Attorney, Agent, or Firm*—Oblon, Spivak, McClelland, Maier & Neustadt

[57] ABSTRACT

A latex lid mounting apparatus includes a seat body and a lid accommodating device with a replaceable lid container. A beverage cup is placed on a cup positioning plate. Lids are superposed in the container. An ascending assembly activates a lid holding unit to move up and down between an upper limit position and a lower limit position. The lid holding unit includes an outer ring, an inner ring journalled in the outer ring, several links connected to the inner and outer rings, and a plurality of paw elements carried on the inner and outer rings. A rotation control device regulates relative rotation between the inner and outer rings, so as to move the paw elements between an inner limit position and an outer limit position. Under the guidance of the rotation control device, the lid holding unit holds the lowermost lid immediately before reaching the upper limit position, while covering the open upper end of the cup with the lid immediately before reaching the lower limit position. The lid holding unit is activated by an upper microswitch to move downward when reaching the upper limit position, and is activated by an lower microswitch to move upward when reaching the lower limit position.

5 Claims, 6 Drawing Sheets

LATEX LID MOUNTING APPARATUS7

BACKGROUND OF THE INVENTION

1. Field of the Invention

This invention relates to an apparatus for mounting a lid on a beverage cup, more particularly to a latex lid mounting apparatus.

2. Description of the Related Art

Because of having flexible and stretchable natures, latex lids have been used widely in fast food stores to close the open upper ends of beverage cups. When mounting a latex lid on a beverage cup, the lower rim of the lid is pulled outward by the hands of a waiter or waitress. Then, the stretched lid is placed on the beverage cup, thus permitting the lower rim of the lid to automatically seal the open upper end of the cup. It is time-consuming to manually mount a latex lid on a beverage cup.

SUMMARY OF THE INVENTION

It is therefore the main object of this invention to provide an apparatus for mounting a latex lid on a beverage cup.

According to this invention, a latex lid mounting apparatus includes a seat body and a lid accommodating device with a replaceable lid container. A beverage cup is placed on a cup positioning plate. Lids are superposed in the container. When a rotary driving source is powered, an ascending assembly activates a lid holding unit to move up and down between an upper limit position and a lower limit position. The lid holding unit includes an outer ring, an inner ring journalled in the outer ring, several links connected to the inner and outer rings, and a plurality of paw elements carried on the inner and outer rings. A rotation control device regulates relative rotation between the inner and outer rings, so as to move the paw elements between an inner limit position and an outer limit position. Under the guidance of the rotation control device, the lid holding unit holds the lowermost lid immediately before reaching the upper limit position, while covering the open upper end of the cup with the lid immediately before reaching the lower limit position. The lid holding unit is activated by an upper microswitch to move downward when reaching the upper limit position, and is activated by a lower microswitch to move upward when reaching the lower limit position.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
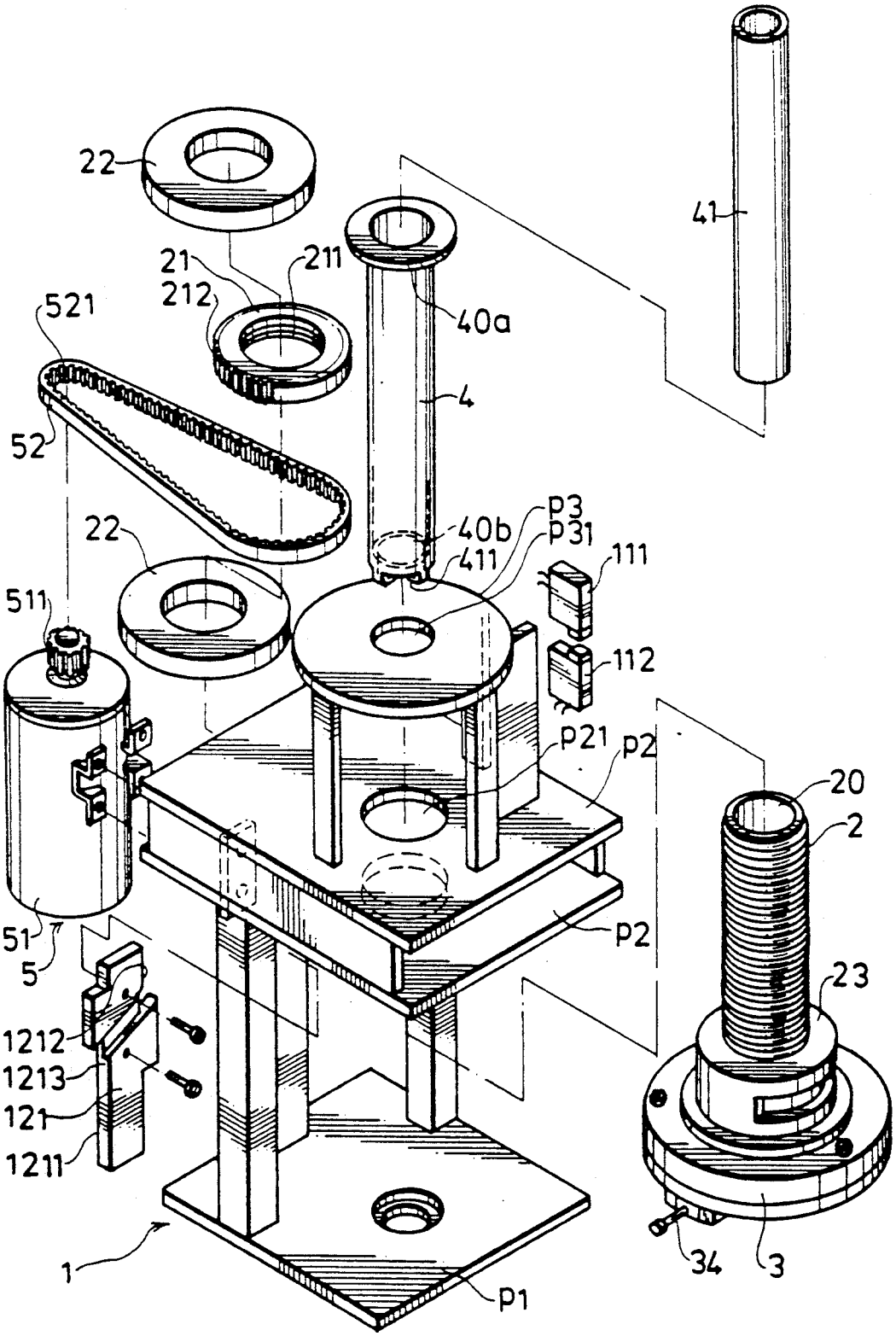
FIG. 1 is a partially exploded view of a latex lid mounting apparatus according to this invention.
Figure 2:
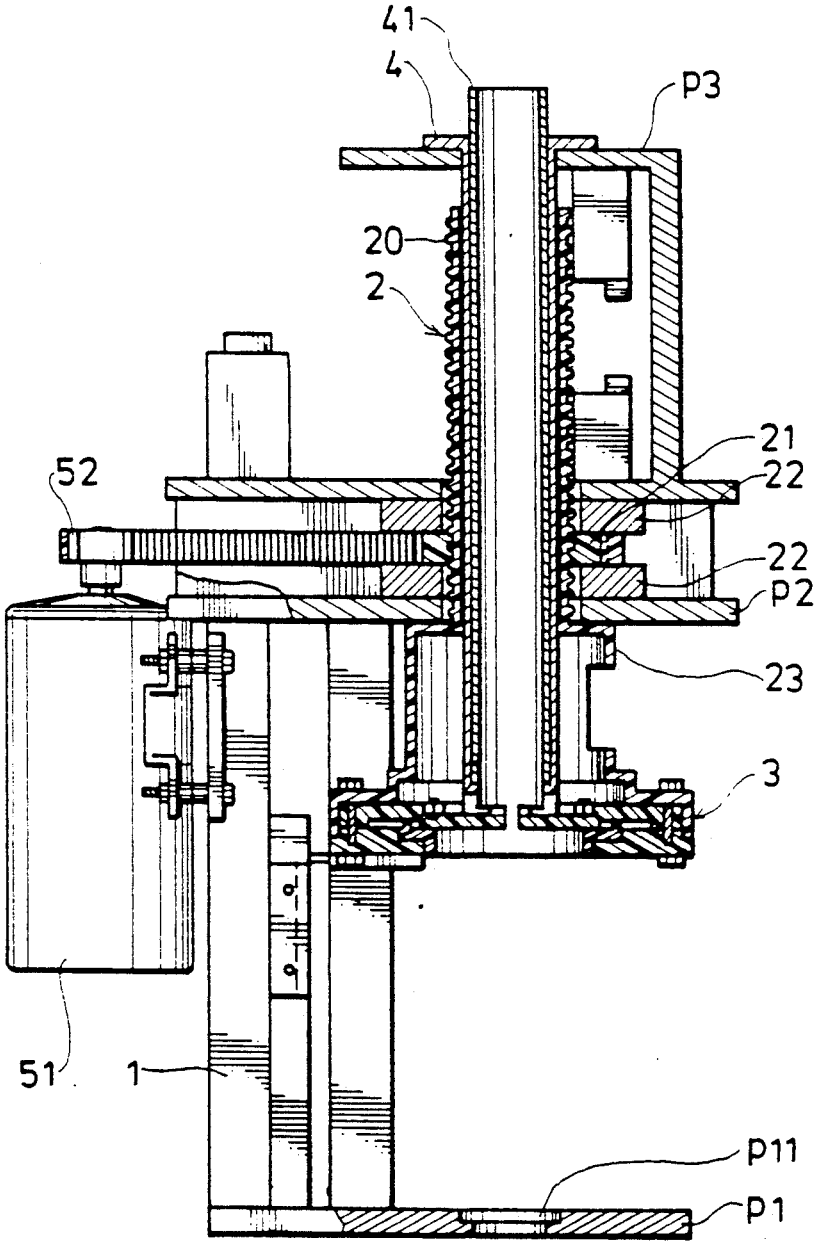
FIG. 2 is a sectional side view showing the latex lid mounting apparatus of this invention.

Referring to FIGS. 1 and 2, a latex lid mounting apparatus of this invention includes a seat body 1, an ascending assembly 2, a lid holding unit 3, an outer tube 4 and a rotary driving source 5.

The seat body 1 includes a lower positioning plate or cup positioning means (P1), two fixed intermediate positioning plates (P2), and a fixed upper positioning plate (P3). The lower positioning plate (P1) has a through hole (P11) with a large-diameter upper portion and a small-diameter lower portion. The lower end portion of a beverage cup is placed in the upper portion of the through hole (P11). Each of the intermediate positioning plates (P2) has an intermediate positioning hole (P21) formed therethrough in alignment with the through hole (P11). The upper positioning plate (P3) also has an upper positioning hole (P31) formed therethrough in alignment with the through hole (P11). An upper microswitch 111 and a lower microswitch 112 are connected to the driving source 5 and located above the intermediate positioning plates (P2). A guide member 121 is fixed on the seat body 1 below the intermediate positioning plates (P2).

The ascending assembly 2 includes an externally threaded drive tube 20, a drive ring 21, two positioning rings 22 and a window portion 23. The drive tube 20 extends in turn through the lower one of the intermediate positioning plates (P2), the lower positioning ring 22, the drive ring 21, the upper positioning ring 22 and the upper one of the intermediate positioning plates (P2), so as to position the drive ring 21 on the seat body 1. The drive ring 21 has an internally threaded portion 211 engaged threadably with the drive tube 20 so as to transfer the rotation of the drive ring 21 to a longitudinal movement of the drive tube 20, and also has an externally toothed portion 212 with an endless series of radial teeth. The window portion 23 is connected securely to the lower end of the drive tube 20.

Figure 3:
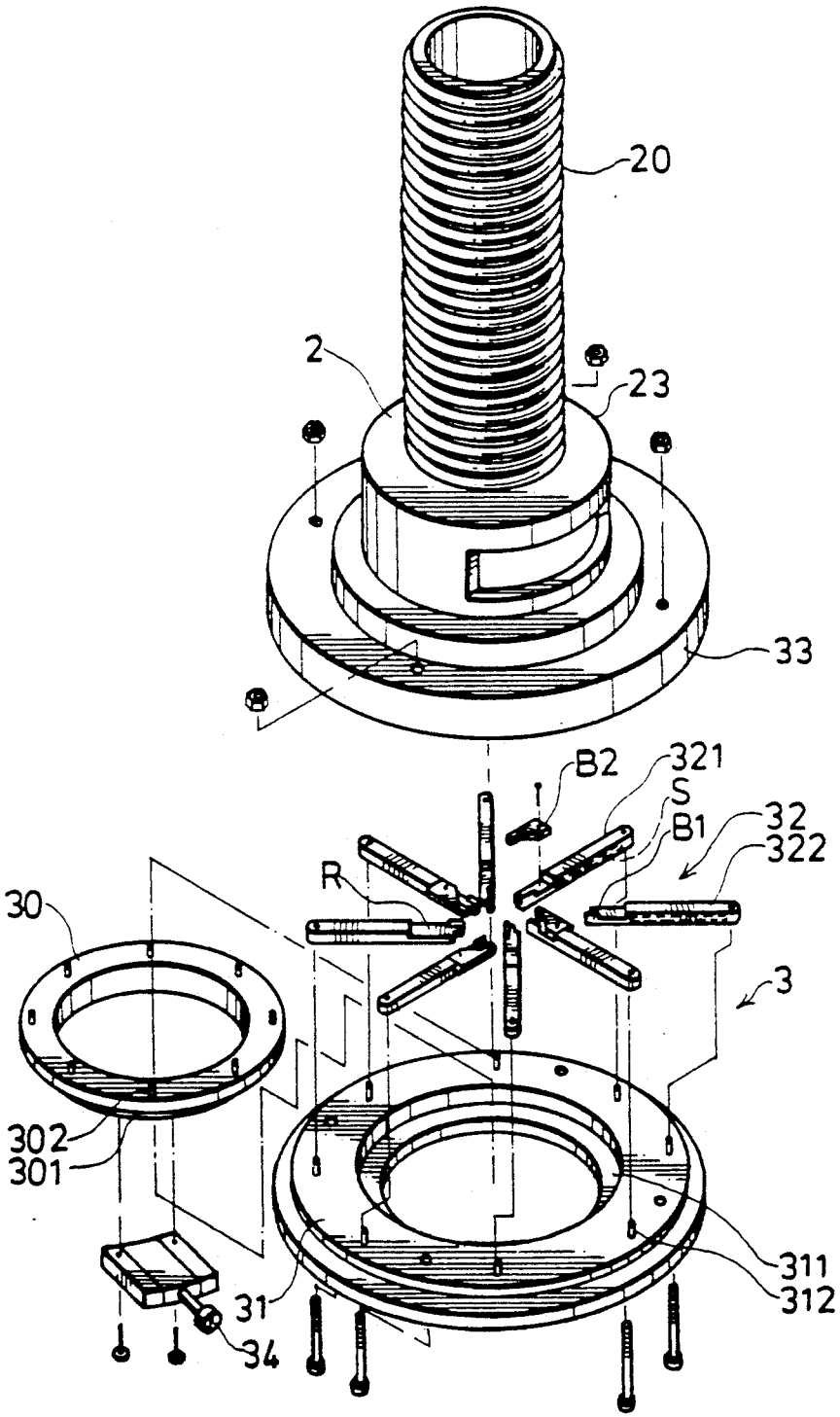
FIG. 3 is an exploded view showing the lid holding unit of the latex mounting apparatus according to this invention.
Figure 4:
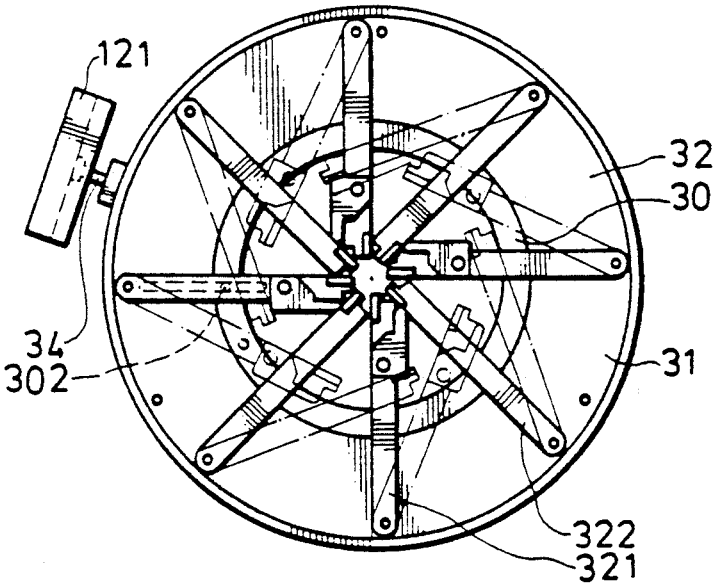
FIG. 4 is a schematic view illustrating the operation of the lid holding unit of the latex lid mounting apparatus according to this invention.

Referring to FIG. 3, the lid holding unit 3 includes an inner ring 30, an outer ring 31, a paw assembly 32, a cover 33 and a guide rod 34. The outer ring 31 is screwed to the cover 33 which is connected securely to the window portion 23 of the ascending assembly 2. The outer ring 31 has an inward flange 311 at the lower end thereof, while the inner ring 30 has an annular downward flange 301 journalled within the inward flange 311, so as to confine the inner ring 30 between the cover 33 and the outer ring 31, in such a manner that the inner ring 30 can rotate in the outer ring 31. The paw assembly 32 includes four sets of alternate male links 321 and female links 322, which are angularly equally spaced apart from each other. Each of the male and female links 321, 322 has a fixed paw element (B1) positioned at the radial inner end thereof, and a recess (R) positioned at the radial inner end portion. Each of the male links 321 further includes a rotatable paw element (B2) mounted pivotally in the recess (R). As illustrated, the outer ring 31 is provided with eight circumferentially equidistant pivot pins 312 so as to connect pivotally to the outer ends of the male and female links 321, 322. Correspondingly, the inner ring 30 is provided with eight circumferentially equidistant guide elements 302. The inner end portions of the male and female links 321, 322 have lengthwise slide slots (S) in which the guide elements 302 are respectively received. The guide rod 34 is screwed to the bottom surface of the inner ring 30 and has an outer end which is outside of the outer ring 31. Accordingly, as best shown in FIG. 4, when the guide rod 34 is rotated clockwise, the paw elements (B1, B2) move to an inner limit position, as indicated by solid lines, in which the rotatable paw elements (B2) of the male links 321 are engaged with the fixed paw elements (B1) of the female links 322, so as to clamp the lower rim of the lowermost lid (L) therebetween. When the guide rod 34 is rotated counterclockwise, the paw elements (B1, B2) move to an outer limit position, as indicated by dotted lines.

Figure 8:
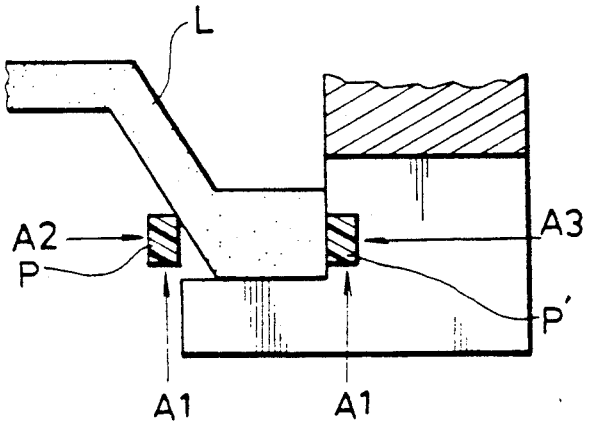
FIG. 8 is a schematic view illustrating how the paw elements of the latex lid mounting apparatus access the lower rim of the lowermost lid in accordance with this invention.

Again referring to FIGS. 1 and 2, the outer tube 4 extends through the drive tube 20 of the ascending assembly 2 and has an upper end outward flange (40*a*) placed on the upper surface of the upper positioning plate (P3), so as to prevent the outer tube 4 from downward movement. An inward flange (40*b*) is provided on the lower end portion of the outer tube 4 so as to support a tubular lid container 41 thereon. The lid container 41 has an open lower end and an open upper end which extends from the upper end of the outer tube 4 so that the user can easily replace the lid container with a new lid container, having a cylindrical chamber in which a plurality of latex lids (L) are superposed. Four circumferentially equidistant L-shaped hanging arms 411 are provided on the lower end of the outer tube 4 and have radially inwardly extending end portions. The inward flange (40*b*) has an inner diameter approximate to that of the lid container 41 so as to allow downward movement of the lids (L) through a space defined by the inward flange (40*b*) of the outer tube 4. The end portions of the L-shaped hanging arms 411 of the outer tube 4 are spaced apart from the inward flange (40*b*) at a distance which allows the rim of the lowermost lid (L) to be supported on the hanging arms 411. Accordingly, referring to FIG. 8, the fixed paw elements (B1) can move to a position (P) in a direction as indicated by an arrow (A1), while the rotatable paw elements (B2) can move to a position (P') in the same direction (A1). At this time, the paw elements (B1, B2) are at the same level as that of the lower rim of the lowermost lid (L). Then, the fixed paw elements (B1) and the rotatable paw elements (B2) move toward each other so as to access the lower rim of the lowermost lid (L) in directions (A2, A3), thereby seizing the lowermost lid (L).

In this embodiment, the rotary driving source 5 is a motor 51 with an externally threaded motor shaft 511. An endless driving belt 52 has an endless series of teeth 521 provided on the inner surface thereof which is trained on the motor shaft 511 and the drive ring 21, so as to rotate the drive ring 21, thereby activating the drive tube 20 to move up and down. Because the outer ring 31 is secured to the drive tube 20, the drive tube 20 moves the lid holding unit 3 between an upper limit position and a lower limit position.

The guide rod 34 and the guide member 121 constitute a rotation control device for the inner ring 30 and the outer ring 31. Again referring to FIG. 1, the guide member 121 has a base portion 1211, an upper projection 1212 secured to the upper portion of the base portion 1211, and a lower projection 1213 secured to the lower portion of the base portion 1211 and spaced apart from the upper projection 1212.

Figure 5:
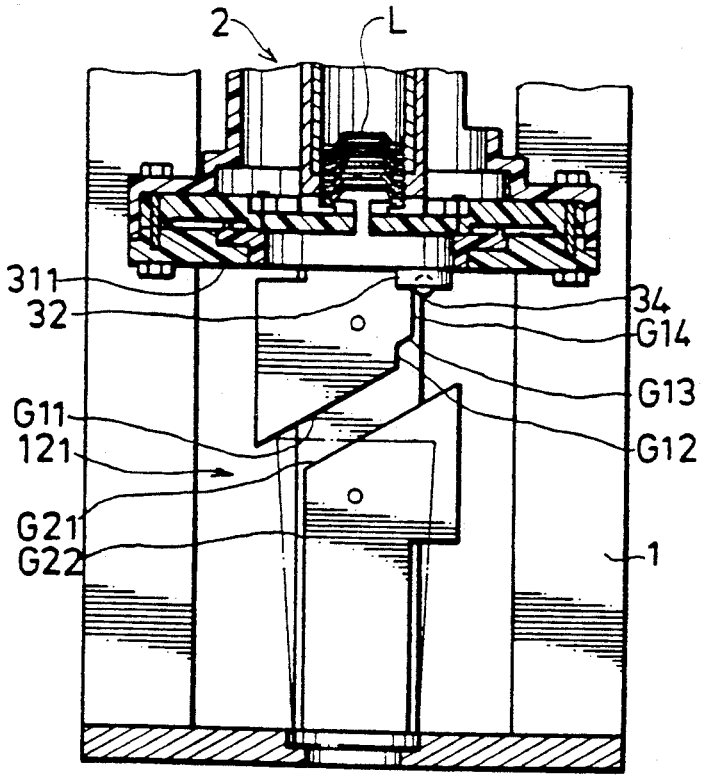
FIGS. 5 to 7 are schematic views illustrating how to move the lid holding unit of the latex lid mounting apparatus to move up and down under the control of a rotation control device in accordance with this invention.
Figure 6:
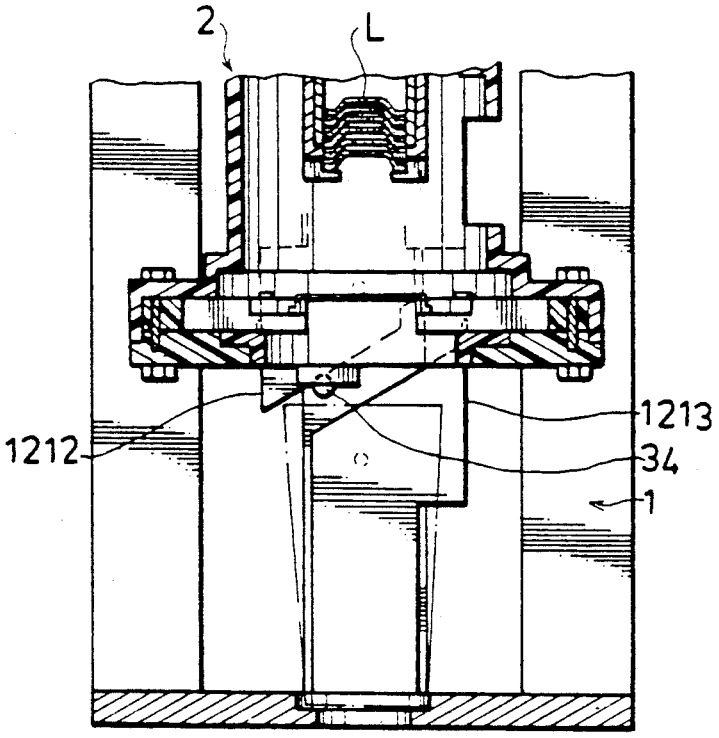
Figure 7:
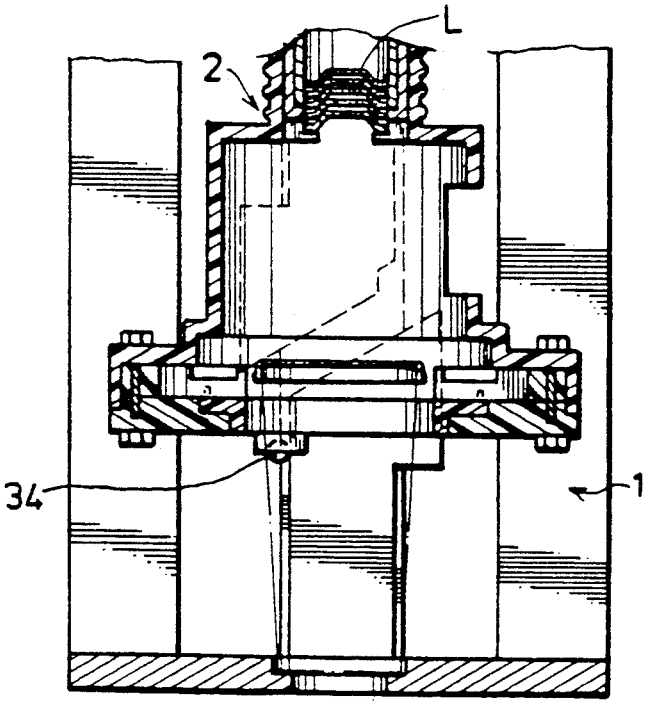

Referring to FIG. 5, the upper projection 1212 has a first guiding surface which has an inclined first section (G11) having a lower end extending from the base portion 1211 to the left a distance greater than that of the adjacent portion of the lower projection 1213, a vertical second section (G12) connected at the lower end thereof to the upper end of the first section (G11), an inclined third section (G13) connected at the lower end thereof to the upper end of the second section (G12), and a vertical fourth section (G14) connected at the lower end thereof to the upper end of the third section (G13). The first section (G11) is located relative to the end of the guide rod 34 so that the end of the guide rod 34 can come into engagement with the lower end portion of the first section (G11) during upward movement of the lid holding unit 3 from the lower limit position. The sliding movement of the end of the guide rod 34 along the inclined first section (G11) urges the paw elements (B1, B2) to move inward from the outer limit position. The sliding movement of the end of the guide rod 34 along the vertical second section (G12) moves the paw elements (B1, B2) upward to level with the lower rim of the lowermost lid (L), so as to position the fixed paw elements (B1) on the inner side of the lower rim of the lowermost lid (L), and to position the rotatable paw elements (B2) on the outer side of the lower rim of the lowermost lid (L). The sliding movement of the end of the guide rod 34 along the inclined third section (G13) moves the paw elements (B1, B2) to the inner limit position, so as to clamp tightly the lower rim of the lowermost lid (L) therebetween. The sliding movement of the end of the guide rod 34 along the vertical fourth section (G14) urges the lid holding unit 3 to carry the lowermost lid (L) therewith to move upward a distance.

The lower projection 1213 has a second guiding surface which has an inclined first section (G21) having an upper end extending from the base portion 1211 to the right a distance greater than that of the adjacent portion of the upper projection 1212, and a vertical second section (G22) connected at the upper end thereof to the lower end of the first section (G21). The first section (G21) is located relative to the end of the guide rod 34 so that the end of the guide rod 34 can come into engagement with the upper end portion of the first section (G21) during downward movement of the lid holding unit 3 from the upper limit position. The sliding movement of the end of the guide rod 34 along the inclined first section (G21) urges the paw elements (B1, B2) to move from the inner limit position to the outer limit position. The sliding movement of the end of the guide rod 34 along the vertical second section (G22) moves the lid holding unit 3 to the lower limit position. When coming into engagement with the open upper end of the cup immediately before the lid holding unit 3 reaches the lower limit position, the lid (L) separates from the lid holding unit 3 and remains on the cup.

With this invention thus explained, it is apparent that numerous modifications and variations can be made without departing from the scope and spirit of this invention. It is therefore intended that this invention be limited only as indicated in the appended claims.

I claim:

1. An apparatus for mounting a latex lid on rim of a beverage cup, comprising:

a seat body;

a lid accommodating device, disposed on a top portion of said seat body, having a cylindrical chamber in which a plurality of latex lids are superposed, in such a manner that a lower rim of the lowermost one of the lids is exposed to exterior of said chamber;

an ascending assembly including an internally threaded first drive member mounted rotatably on said seat body and rotatable about a longitudinal axis, and an externally threaded second drive member engaged threadably with said first drive member;

a rotary driving source activating said first drive member to rotate so as to move said second drive member longitudinally relative to said seat body;

a lid holding unit mounted movably on said seat body under said lid accommodating device and including an outer ring, an inner ring journalled within said outer ring and provided with several circumferentially equidistant guiding elements, several radially extending links angularly equally spaced apart from each other, a first set of paw elements mounted on said links, and a second set of paw elements mounted on said links, each of said links having an outer end connected pivotally to said outer ring and having an inner end with a lengthwise slide slot in which one of said guiding elements of said inner ring is received, said inner and outer rings being carried on said second drive member so as to move said lid holding unit between an upper limit position and a lower limit position, said inner ring being capable of rotating relative to said outer ring so as to move said first and second sets of paw elements between an inner limit position and an outer limit position rotation of said inner ring relative to said outer ring in a first direction moving said first and second sets of paw elements to said inner limit position, while rotation of said inner ring relative to said outer ring in a second direction, which is opposite to said first direction, moves said first and second sets of paw elements to said outer limit position;

a cup positioning means disposed on a bottom portion of said seat body, so that a beverage cup is placed in a predetermined position on said seat body under the lower limit position of said lid holding unit;

a rotation control device controlling rotational direction of said inner ring, so as to move said first and second sets of paw elements to said inner limit position when said lid holding unit moves to said upper limit position, where the lower rim of the lowermost lid is clamped tightly between said first and second sets of paw elements, and to move said first and second sets of paw elements to said outer limit position when said lid holding unit moves to said lower limit position;

an upper microswitch, connected to said rotary driving source, activated by one of said ascending assembly and said lid holding unit to move said lid holding unit downward when said lid holding unit reaches said upper limit position; and a lower microswitch, connected to said rotary driving source, activated by one of said ascending assembly and said lid holding unit to move said lid holding unit upward when said lid holding unit reaches said lower limit position;

whereby said lid holding unit can move the lowermost lid downward to engage with an open upper end of the beverage cup immediately before said lid holding unit reaches said lower limit position.

2. An apparatus as claimed in claim 1, wherein said first drive member is a drive ring which has an internally threaded portion and an externally toothed portion with an endless series of radial teeth, said ascending assembly including a motor mounted on said seat body and having an externally toothed motor shaft with an endless series of radial teeth, and an endless driving belt having an endless series of teeth provided on an inner surface thereof, which is trained on said externally toothed portion of said drive ring and said externally toothed motor shaft, so as to transfer rotation of said motor shaft to said drive ring.

3. An apparatus as claimed in claim 1, wherein said second drive member is an externally threaded drive tube mounted securely on said outer ring of said lid holding unit and has an open upper end, said seat body including two parallel intermediate positioning plates fixed thereon, said intermediate positioning plates having two aligned intermediate positioning holes formed therethrough, said drive tube extending through said intermediate positioning holes said lid holding unit being positioned under said intermediate positioning plates, said lid accommodating device including an upper positioning plate fixed on said seat body above said intermediate positioning plates and having an upper positioning hole formed through said upper positioning plate in alignment with said intermediate positioning holes, an outer tube extending through said drive tube and having an upper end outward flange placed on an upper surface of said upper positioning plate so as to prevent said outer tube from downward movement, and a tubular lid container placed within said outer tube and having open upper and lower ends, the upper end of said lid container extending from the upper end of said outer tube so that a user can easily remove said lid container from said outer tube, said outer tube having an inward flange at a lower end portion thereof on which the lower end of said lid container is placed, and several L-shaped hanging arms with radially inwardly extending end portions positioned below said inward flange of said outer tube, said inward flange of said outer tube having an inner diameter approximate to that of said lid container so as to allow downward movement of the lids through a space defined by said inward flange of said outer tube, said end portions of said L-shaped hanging arms of said outer tube being spaced apart from said inward flange at a distance which allows the lower rim of the lowermost lid to be supported on said hanging arms and positioned below said inward flange, whereby said first and second sets of paw elements can gain access to the lower rim of the lowermost lid so as to seize the lowermost lid.

4. An apparatus as claimed in claim 3, wherein said rotation control device includes a guide rod radially outwardly extending from said inner ring and having an outer end outside said outer ring, and a guide member fixed on said seat body and having a base portion, an upper projection secured to an upper portion of a surface of said base portion, and a lower projection secured to a lower portion of said surface of said base portion and spaced apart from said upper projection at a distance, said upper projection having a first guiding surface which has an inclined first section having a lower end extending laterally from said base portion in a direction a distance greater than that of an adjacent portion of said lower projection, a vertical second section connected at a lower end thereof to an upper end of said first section of said first guiding surface, an inclined third section connected at a lower end thereof to an upper end of said second section of said first guiding surface, and a vertical fourth section connected at a lower end thereof to an upper end of said third section of said first guiding surface, said first section of said first guiding surface being located relative to the end of said guide rod so that the end of said guide rod can come into engagement with a lower end portion of said first section of said first guiding surface during upward movement of said lid holding unit from the lower limit position, sliding movement of the end of said guide rod along said inclined first section of said first guiding surface urging said first and second sets of paw elements to move inward from the outer limit position, sliding movement of the end of said guide rod along said vertical second section of said first guiding surface moving said first and second sets of paw elements upward to level with the lower rim of the lowermost lid, so as to position said first set of paw elements on an inner side of the lower rim of the lowermost lid, and to position said second set of paw elements on an outer side of the lower rim of the lowermost lid, sliding movement of the end of said guide rod along said inclined third section of said first guiding surface moving said first and second sets of paw elements to the inner limit position, so as to clamp tightly the lower rim of the lowermost lid therebetween, sliding movement of the end of said guide rod along said vertical fourth section of said first guiding surface urging said lid holding unit to carry the lowermost lid therewith to move upward a distance.

5. An apparatus as claimed in claim 4, wherein said lower projection has a second guiding surface which has an inclined first section having an upper end extending laterally from said base portion at a distance greater than that of an adjacent portion of said upper projection in a direction which is opposite to that of said first section of said first guiding surface, and a vertical second section connected at an upper end thereof to a lower end of said first section of said second guiding surface, said first section of said second guiding surface being located relative to the end of said guide rod so that the end of said guide rod can come into engagement with an upper end portion of said first section of said second guiding surface during downward movement of said lid holding unit from the upper limit position, sliding movement of the end of said guide rod along said inclined first section of said second guiding surface urging said first and second sets of paw elements to move from the inner limit position to the outer limit position, sliding movement of the end of said guide rod along said vertical second section of said second guiding surface moving said lid holding unit to the lower limit position.

* * * * *